US009255712B2

(12) United States Patent
Yantis et al.

(10) Patent No.: US 9,255,712 B2
(45) Date of Patent: Feb. 9, 2016

(54) OVEN APPLIANCE WITH DOORS HAVING A TONGUE AND GROOVE INTERFACE

(75) Inventors: John Adam Yantis, Prospect, KY (US); John Mark Chilton, Campbellsburg, KY (US); Scott Thomas Kershner, LaGrange, KY (US); Eric Sugalski, Malvern, PA (US); David Schoon, Somerville, MA (US); David Perry, Cambridge, MA (US)

(73) Assignee: General Electric Company, Schenectady, NY (US)

( * ) Notice: Subject to any disclaimer, the term of this patent is extended or adjusted under 35 U.S.C. 154(b) by 645 days.

(21) Appl. No.: 13/614,068

(22) Filed: Sep. 13, 2012

(65) Prior Publication Data

US 2014/0069409 A1 Mar. 13, 2014

(51) Int. Cl.

| | |
|---|---|
| ***F23M 7/04*** | (2006.01) |
| ***F24C 15/04*** | (2006.01) |
| ***F24C 15/02*** | (2006.01) |
| *F23M 7/00* | (2006.01) |

(52) U.S. Cl.
CPC ..... *F24C 15/02* (2013.01)

(58) Field of Classification Search
CPC ..... F24C 15/02; F24C 15/021; F24C 23/087
USPC ..... 126/198
See application file for complete search history.

(56) References Cited

U.S. PATENT DOCUMENTS

| | | | | |
|---|---|---|---|---|
| 2,708,709 | A * | 5/1955 | Pearce | 219/414 |
| 3,660,940 | A * | 5/1972 | Tavano | 49/366 |
| 4,225,970 | A * | 9/1980 | Jaramillo et al. | 455/90.3 |
| 2007/0246036 | A1 | 10/2007 | Larsen et al. | |

* cited by examiner

*Primary Examiner* — Kenneth Rinehart
*Assistant Examiner* — Wesley Anderson, Jr.
(74) *Attorney, Agent, or Firm* — Dority & Manning, P.A.

(57) ABSTRACT

An oven appliance with a cabinet that defines a chamber is provided. A pair of doors is mounted proximate the cabinet and provides selective access to the cabinet. One of the pair of doors includes a tongue. Another of the pair of doors defines a groove configured for receipt of the tongue when the pair of doors is in a closed position. The tongue and groove can limit heat loss through a gap between the pair of doors or assist with sealing the pair of doors against the cabinet.

18 Claims, 11 Drawing Sheets

OVEN APPLIANCE WITH DOORS HAVING A TONGUE AND GROOVE INTERFACE

FIELD OF THE INVENTION

The present subject matter relates generally to oven appliances, e.g., French door oven appliances.

BACKGROUND OF THE INVENTION

Oven appliances generally include a cabinet that defines a chamber for receipt of food items for cooking. The oven appliance's cabinet also defines an opening that permits access to the chamber. A door or doors mounted at the opening of the cabinet can selectively limit access to the chamber of the cabinet. For example, an oven appliance can include a pair of doors rotatably mounted at the opening of the cabinet. Such oven appliances are generally referred to as French door oven appliances. The pair of doors can be connected with a linkage assembly that rotates the pair of doors open and closed simultaneously.

The doors of French door oven appliances can engage one another when the doors are in a closed position. Generally, the doors of French door oven appliances engage one another in either a butt joint interface or a lap joint interface. For example, sidewalls of the doors can face one another when the doors are in a closed position such that the doors meet in the butt joint interface. Conversely, the sidewalls of the doors can include complementary projections that engage one another such that the doors meet in the lap joint interface.

However, the butt joint and lap joint interfaces described above have certain limitations. For example, heat within the oven appliance's chamber can easily flow through a gap between the pair of doors when the doors have a butt joint interface. On the other hand, the pair of doors may seal poorly against the oven appliances cabinet when the doors have a lap joint interface.

Accordingly, an oven appliance having an improved interface between a pair of doors when the doors are in a closed position would be useful. In particular, an oven appliance having an interface between a pair of doors that limits heat loss through a gap between the doors and/or that assists the doors in sealing against a cabinet of the oven appliance when the doors are in a closed position would be useful

BRIEF DESCRIPTION OF THE INVENTION

The present subject matter provides an oven appliance with a cabinet that defines a chamber. A pair of doors is mounted proximate the cabinet and provides selective access to the cabinet. One of the pair of doors includes a tongue. Another of the pair of doors defines a groove configured for receipt of the tongue when the pair of doors is in a closed position. The tongue and groove can limit heat loss through a gap between the pair of doors or assist with sealing the pair of doors against the cabinet. Additional aspects and advantages of the invention will be set forth in part in the following description, or may be apparent from the description, or may be learned through practice of the invention.

In a first exemplary embodiment, an oven appliance is provided. The oven appliance defines a vertical direction, a lateral direction, and a transverse direction. The vertical, lateral, and transverse directions are mutually perpendicular. The oven appliance includes a cabinet that defines a chamber for receipt of food items for cooking. The cabinet also defines an opening. The chamber of the cabinet is accessible through the opening of the cabinet. The oven appliance also includes a heating element for providing heat to food items in the chamber of the cabinet. A first door is mounted proximate the opening of the cabinet. The first door has an inner surface and an outer surface. The first door also has a sidewall that extends between and connects the inner and outer surfaces of the first door. The first door further has a tongue. The tongue of the first door is positioned on the sidewall of the first door and extends away from the sidewall of the first door. The tongue is spaced apart from both the inner and outer surfaces of the first door. A second door is mounted proximate the opening of the cabinet. The second door has an interior surface and an exterior surface. The second door also has a spanning wall that extends between and connects the interior and exterior surfaces of the second door. The spanning wall of the second door defines a groove configured for receipt of the tongue of the first door when the first and second doors are in a closed position. The groove of the spanning wall is spaced apart from both the interior and exterior surfaces of the second door.

In a second exemplary embodiment, an oven appliance is provided. The oven appliance extends between a top and a bottom along a vertical direction. The oven appliance also extends between a first side and a second side along a lateral direction. The oven appliance further extends between a front and a back along a transverse direction. The vertical, lateral, and transverse directions are mutually perpendicular. The oven appliance includes a cabinet that defines a chamber for receipt of food items for cooking. The cabinet also defines an opening. The chamber of the cabinet is accessible through the opening of the cabinet. The oven appliance also includes a heating element for providing heat to food items in the chamber of the cabinet. A first door is rotatably mounted on the first side of the oven appliance proximate the opening of the cabinet. The first door extends between a top and a bottom along the vertical direction. The first door includes an inner surface, an outer surface, and a first sidewall that extends between and connects the inner surface and the outer surface. A tongue is positioned on the first sidewall. The tongue has a distal portion that is spaced apart from the first sidewall. The tongue extends longitudinally between the top of the first door and the bottom of the first door along the vertical direction. A second door is rotatably mounted on the second side of the oven appliance proximate the opening of the cabinet. The second door includes an interior surface, an exterior surface, and a second sidewall that extends between and connects the interior surface and the exterior surface. The second sidewall defines a groove configured for receipt of the tongue when the first and second doors are in the closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

In FIG. 10, the first and second doors of the oven appliance are shown in a closed position.

In FIG. 11, the tongue is positioned within the groove.

DETAILED DESCRIPTION

Figure 1:
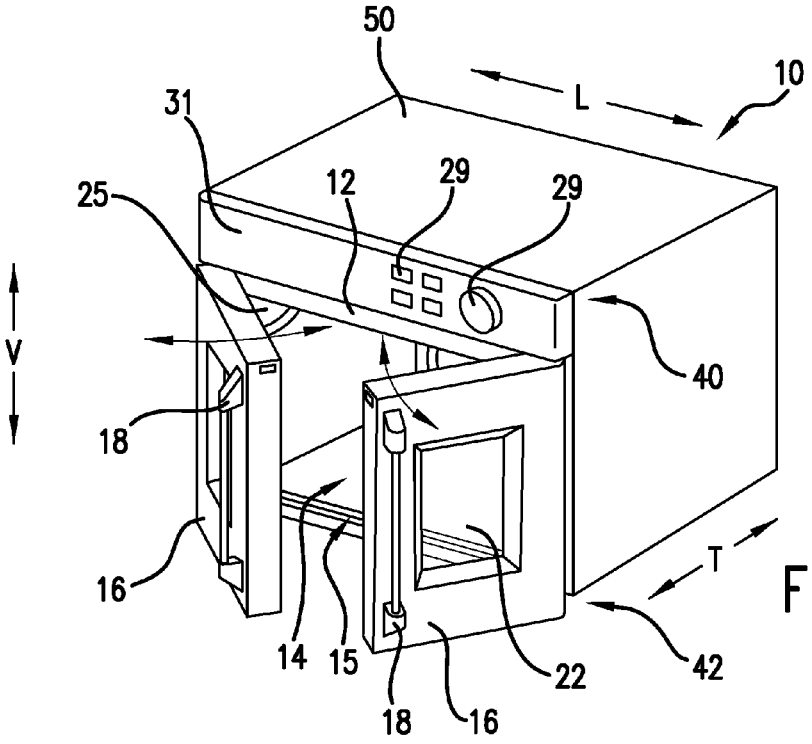
FIG. 1 provides a front perspective view of an exemplary oven appliance according to an exemplary embodiment of the present subject matter and, in particular, illustrates a pair of doors of the oven appliance.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
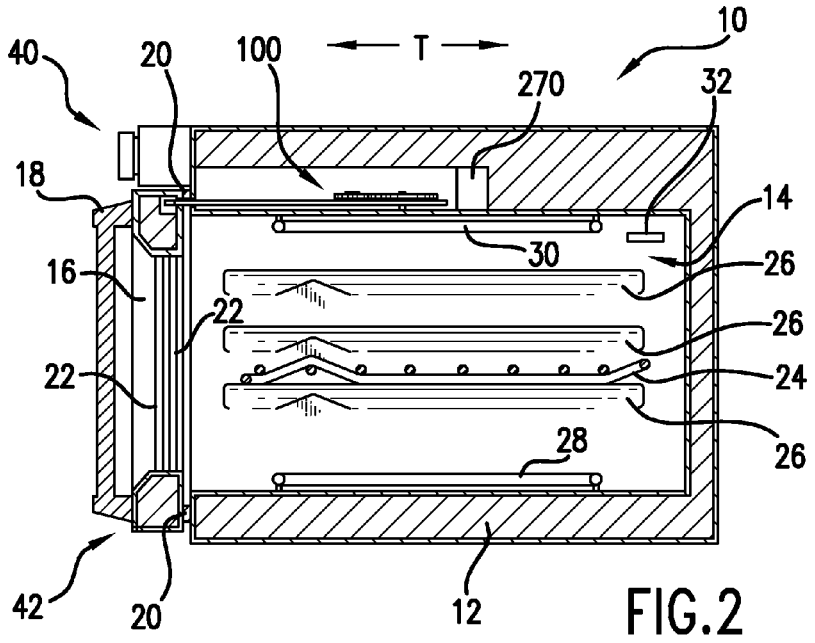
FIG. 2 provides a side cross-sectional view of the oven appliance of FIG. 1 and, in particular, illustrates a linkage assembly that connects the pair of doors such that each door of the pair of doors rotates open and closed simultaneously.

FIGS. 1 and 2 illustrate an oven appliance 10 according to an embodiment of the present subject matter. Oven appliance 10 includes an insulated cabinet 12 with an interior surface 25 that defines an interior cooking chamber 14. Cooking chamber 14 is configured for the receipt of one or more food items to be cooked.

Oven appliance 10 defines a vertical direction V, a lateral direction L, and a transverse direction T. Vertical direction V, lateral direction L, and transverse direction T are mutually perpendicular and form an orthogonal direction system. Oven appliance 10 extends between a top 40 and a bottom 42 along the vertical direction V.

Oven appliance 10 also includes a pair of pair of doors 16, sometimes referred to as "French doors," that are rotatably mounted on cabinet 12. Thus, oven appliance 10 is sometimes referred to as a French door style oven appliance. Pair of doors 16 are mounted proximate an opening 15 defined by cabinet 12. Opening 15 permits access to cooking chamber 14. Pair of doors 16 is configured for selectively shifting between an open position shown in FIG. 1 in which a user can access cooking chamber 14 and a closed position shown in FIG. 2 in which the user is impeded from accessing cooking chamber 14 by pair of doors 16. Handles 18 are attached to pair of doors 16 and allow for opening and/or closing one or both of the pair of doors 16.

As may be seen in FIG. 2, one or more seals 20 between pair of doors 16 and cabinet 12 provide for maintaining heat and cooking fumes within cooking chamber 14 when pair of doors 16 is in the closed position. Glass panes 22 provide for viewing the contents of cooking chamber 14 when pair of doors 16 is in the closed position as well as providing insulation between cooking chamber 14 and the exterior of oven appliance 10. A rack 24 is positioned in cooking chamber 14 for the receipt of food items. Rack 24 is slidably received onto ribs or rails 26 such that rack 24 may be conveniently moved into and out of cooking chamber 14 when pair of doors 16 is open. Multiple rails 26 are provided so that the height of rack may be adjusted.

Heating elements or sources 28 and 30 are positioned within the cooking chamber 14 of cabinet 12. Heating elements 28 and 30 are used to heat cooking chamber 14 for both cooking and cleaning of oven appliance 10. While electrically-resistive heating elements 28 and 30 are shown, the present subject matter may be used with other heating elements as well such as gas burners or microwave elements.

The operation of oven appliance 10 including heating elements 28 and 30 is controlled by one or more processing devices (not shown), e.g., a microprocessor. User manipulated controls 29 on control panel 31 allow the user to make selections regarding temperature, time, and other options. The selections can be communicated to the processing device for operation of oven appliance 10. Such processing device is also in communication with a temperature sensor 32 that is used to measure temperature inside cooking chamber 14.

Oven appliance 10 is provided by way of example only. Thus, the present subject matter may be used with other oven configurations, e.g., an oven range. As another example, the present subject matter may be used with an oven defining multiple interior cavities for the receipt of food and/or having different pan or rack arrangements than what is shown in FIG. 2. Heating elements at the top, back, or sides of chamber 14 may also be provided. The present subject matter may also be used with ovens having a variety of different types of heating elements such as microwave, halogen, gas fuel, electrical resistance, and combinations thereof. Doors 16 may also be mounted to cabinet 12 in any other suitable manner or configuration. Other configurations may also be used as will be understood by one of skill in the art using the teachings disclosed herein.

As may be seen in FIG. 2, a linkage assembly 100 is positioned adjacent top 40 of cabinet 12. Linkage assembly 100 connects pair of doors 16 such that both doors of pair of doors 16 rotate open and closed simultaneously. Thus, for example, a user may pull on one of handles 18 in order to open both doors of pair of doors 16. Linkage assembly 100 is mounted within a hood 50 of cabinet 12 positioned at top 40 of oven appliance 10. Linkage assembly 100 is discussed in greater detail below.

Figure 3:
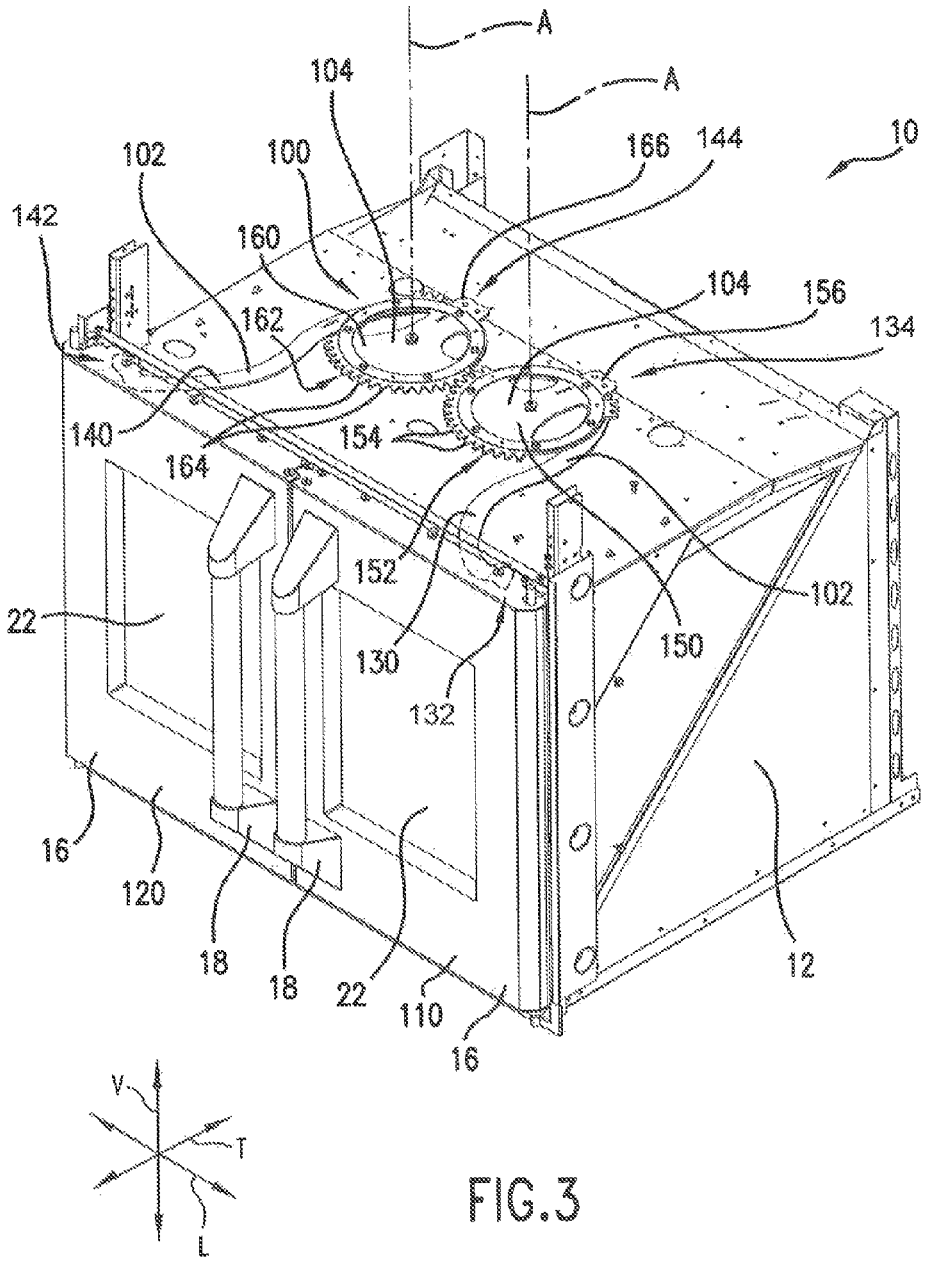
FIG. 3 provides a perspective view of the oven appliance of FIG. 1 with a hood of the cabinet removed to show the linkage assembly of the oven appliance.

FIG. 3 provides a perspective view of oven appliance 10 with hood 50 (FIG. 1) of cabinet 12 removed to more clearly show linkage assembly 100 of oven appliance 10. As may be seen in FIG. 3, linkage assembly 100 includes a pair of gears 104. Each gear of pair of gears 104 has an axis of rotation A about which the gear is rotatable. Pair of gears 104 engage one another, e.g., to transfer rotation motion between pair of doors 16. Linkage assembly 100 also includes a pair of linkage arms 102. Each linkage arm of pair of linkage arms 102 extends between and connects one of the pair of doors 16 and one of the pair of gears 104.

In particular, as may be seen in FIG. 3, pair of doors 16 includes a first door 110 and a second door 120. Also, pair of linkage arms 102 includes a first linkage arm 130 and a second linkage arm 140. In addition, pair of gears 104 includes a first gear 150 and a second gear 160. First and second gears 150 and 160 are rotatably mounted to cabinet 12. In alternative exemplary embodiments, first and second gears 150 and 160 may be rotatably mounted to other portions of oven appliance 10, e.g., hood 50 (FIG. 1).

First linkage arm 130 extends between a first end portion 132 and a second end portion 134. Similarly, second linkage arm 140 extends between a first end portion 142 and a second end portion 144. First end portion 132 of first linkage arm 130 is rotatably connected to first door 110, and second end portion 134 of first linkage arm 130 is rotatably connected to first gear 150. First end portion 142 of second linkage arm 140 is rotatably connected to second door 120, and second end portion 144 of second linkage arm 140 is rotatably connected to second gear 160.

First gear 150 and second gear 160 each have an engagement edge 152 and 162, respectively. Engagement edge 152 of first gear 150 is positioned on first gear 150 such that engagement edge 152 is radially spaced apart from the axis of rotation A of first gear 150. Similarly, engagement edge 162 of second gear 160 is positioned on second gear 162 such that engagement edge 162 is radially spaced apart from the axis of rotation A of second gear 160.

First gear 150 and second gear 160 also both have a plurality of teeth 154 and 164, respectively. The plurality of teeth 152 of first gear 150 engages the plurality of teeth 162 of second gear 160 to transfer rotation motion between first door 110 and second door 120. The plurality of teeth 154 of first gear 150 is disposed on engagement edge 152 of first gear 150. Similarly, the plurality of teeth 164 of second gear 160 is disposed on engagement edge 162 of second gear 160. In particular, pluralities of teeth 154 and 164 are uniformly distributed, e.g., circumferentially, on engagement edges 152 and 162 of first and second gears 150 and 160, respectively.

First and second gears 150 and 160 each have a leg 156 and 166, respectively. Leg 156 of first gear 150 extends away from axis of rotation A of first gear 150, and leg 166 of second gear 160 extends away from the axis of rotation A of second gear 160. Second end portion 134 of first linkage arm 130 is rotatably mounted to leg 156 of first gear 150, and second end portion 144 of second linkage arm 140 is rotatably mounted to leg 166 of second gear 160.

As may be seen in FIG. 3, first and second gears 150 and 160 are substantially identical. Thus, each gear of pair of gears 104 is interchangeable with the other of the pair of gears 104. Similarly, first and second linkage arms 130 and 140 are substantially identical (e.g., in FIG. 3, first and second linkage arms 130 and 140 are ogee shaped). Thus, each linkage arm of pair of linkage arms 102 is interchangeable with the other of the pair of linkage arms 102. Such interchangeability between components of linkage assembly 100 can lower manufacturing costs and/or facilitate assembly of linkage assembly 100 and oven appliance 100.

Linkage assembly 100 connects first and second doors 110 and 120 such that first and second doors 110 and 120 rotate open and closed simultaneously. As an example, with first and second doors 110 and 120 in the closed position show in FIG. 3, a user may pull on handle 18 of first door 110 (or handle 18 of second door 120) to urge first door 110 to begin rotating open. As first door 110 beings to rotate open, first linkage arm 130 can transfer such rotation motion to first gear 150. In turn, plurality of teeth 154 of first gear 150 engages plurality of teeth 164 of second gear 160 to transfer such rotation motion from first gear 150 to second gear 160. Second gear 160 then transfers such rotation motion to second door 120 via second linkage arm 140. Thus, linkage assembly 100 can transfer rotation motion generated by the user between the first door 110 and the second door 120 to shift first and second doors 110 and 120 to the open position shown in FIG. 1.

As will be understood by those skilled in the art, linkage assembly 100 is provided by way of example only. Other suitable alternative mechanisms may be used to connect pair of doors 16 such that each door of pair of doors 16 rotates open and closed simultaneously.

FIGS. 4, 6, 8, and 10 are top sectional views of oven appliance 10 with first and second doors 110 and 120 shown in various positions. As an example, a user can shift the first and second doors 110 and 120 from the open position in FIG. 4 to the closed position shown in FIG. 10, e.g., in order to seal the cooking chamber 14 (FIG. 1) with first and second doors 110 and 120. FIGS. 5, 7, 9, and 11 are partial, elevation views of a tongue 200 of the first door 110 and a groove 210 of the second door 120 in various degrees of engaging one another. In the example described above, as the user shifts the first and second doors 110 and 120 from the open position to the closed position, tongue 200 of first door 110 is received by groove 210 of second door 120, e.g., in order to seal cooking chamber 14 (FIG. 1) and/or secure first and second doors 110 and 120 in the closed position as described in greater detail below.

Figure 4:
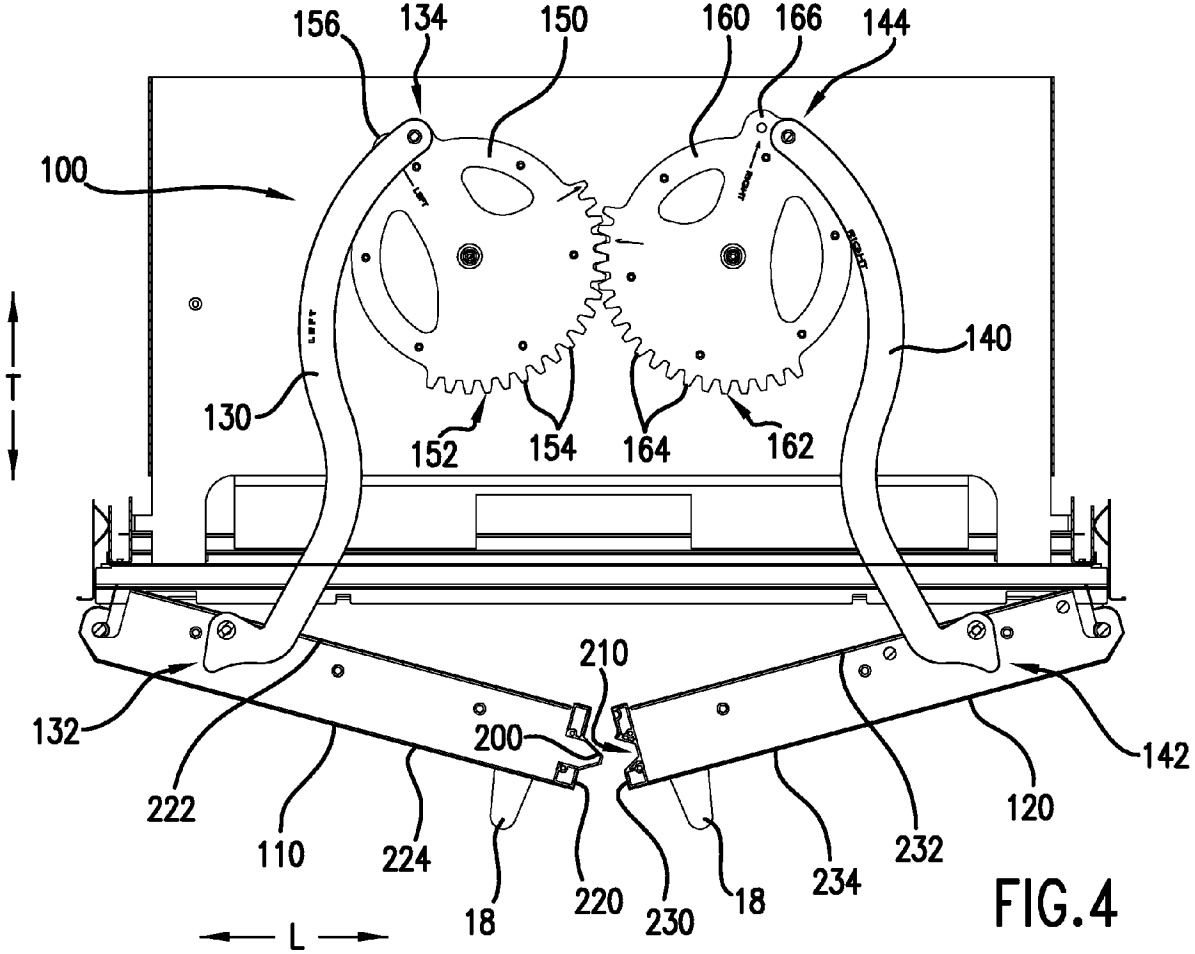
FIGS. 4, 6, 8, and 10 are top sectional views of the oven appliance of FIG. 1 with the first and second doors of the oven appliance shown in various positions.

As may be seen in FIG. 4, first door 110 has an inner surface 222 and an outer surface 224. Inner surface 222 is spaced apart from and faces outer surface 224. First door 110 also has a sidewall or first sidewall 220 that extends between and connects the inner and outer surfaces 222 and 224 of first door 110. Similarly, second door 120 has an interior surface 232 and an exterior surface 234. Interior surface 232 is spaced apart from and faces exterior surface 234. Second door 120 also has a spanning wall or second sidewall 230 that extends between and connects the interior and exterior surfaces 232 and 234 of second door 120. As may be seen in FIG. 10, when first and second doors 110 and 120 are in the closed position, sidewall 220 of first door 110 is positioned adjacent and faces spanning wall 230 of second door 120. In particular, sidewall 220 of first door 110 and spanning wall 230 of second door 120 cooperate to form a tongue and groove interface between the first and second doors 110 and 120 when first and second doors 110 and 120 are in the closed position as described in greater detail below.

Figure 5:
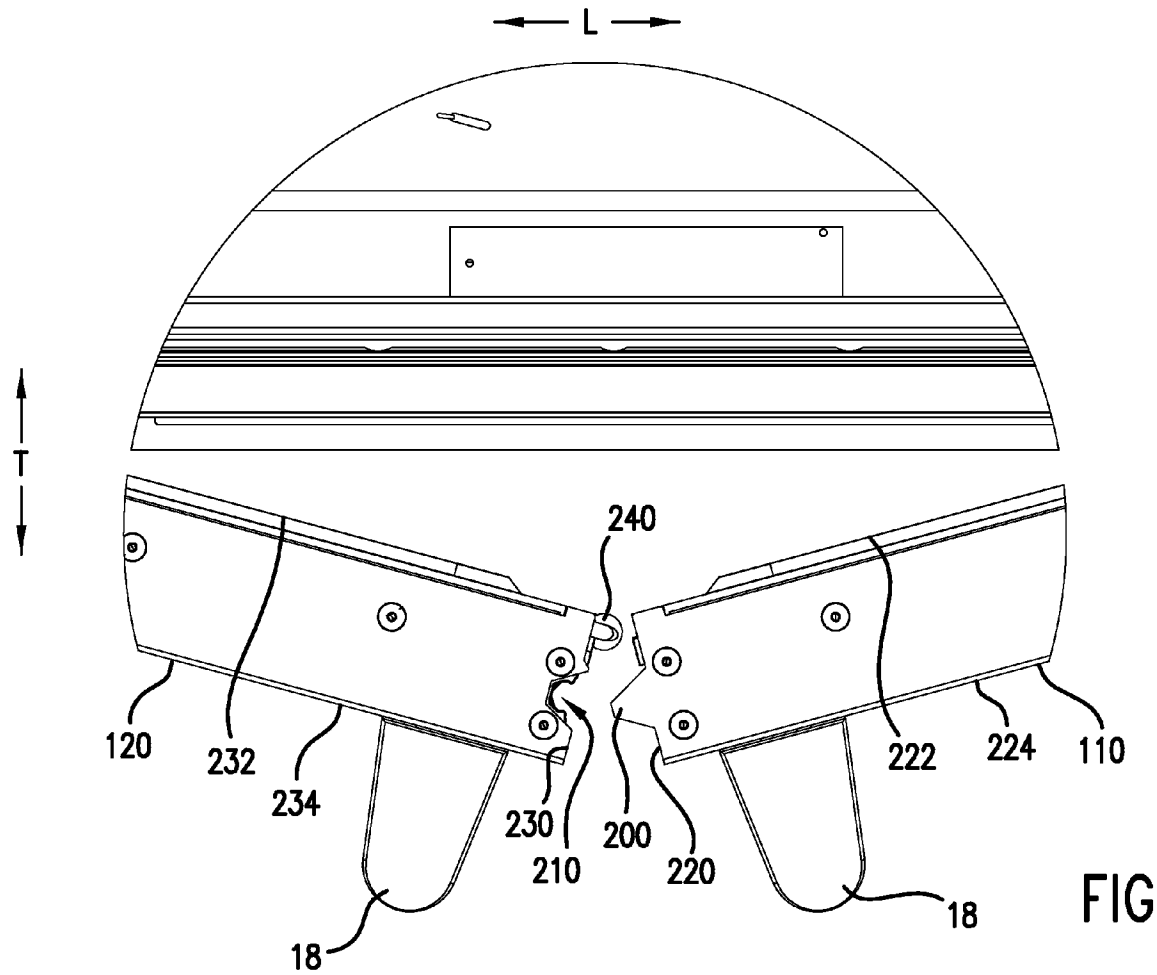
FIGS. 5, 7, 9, and 11 are partial, elevation views of the tongue of the first door and the groove of the second door.
Figure 6:
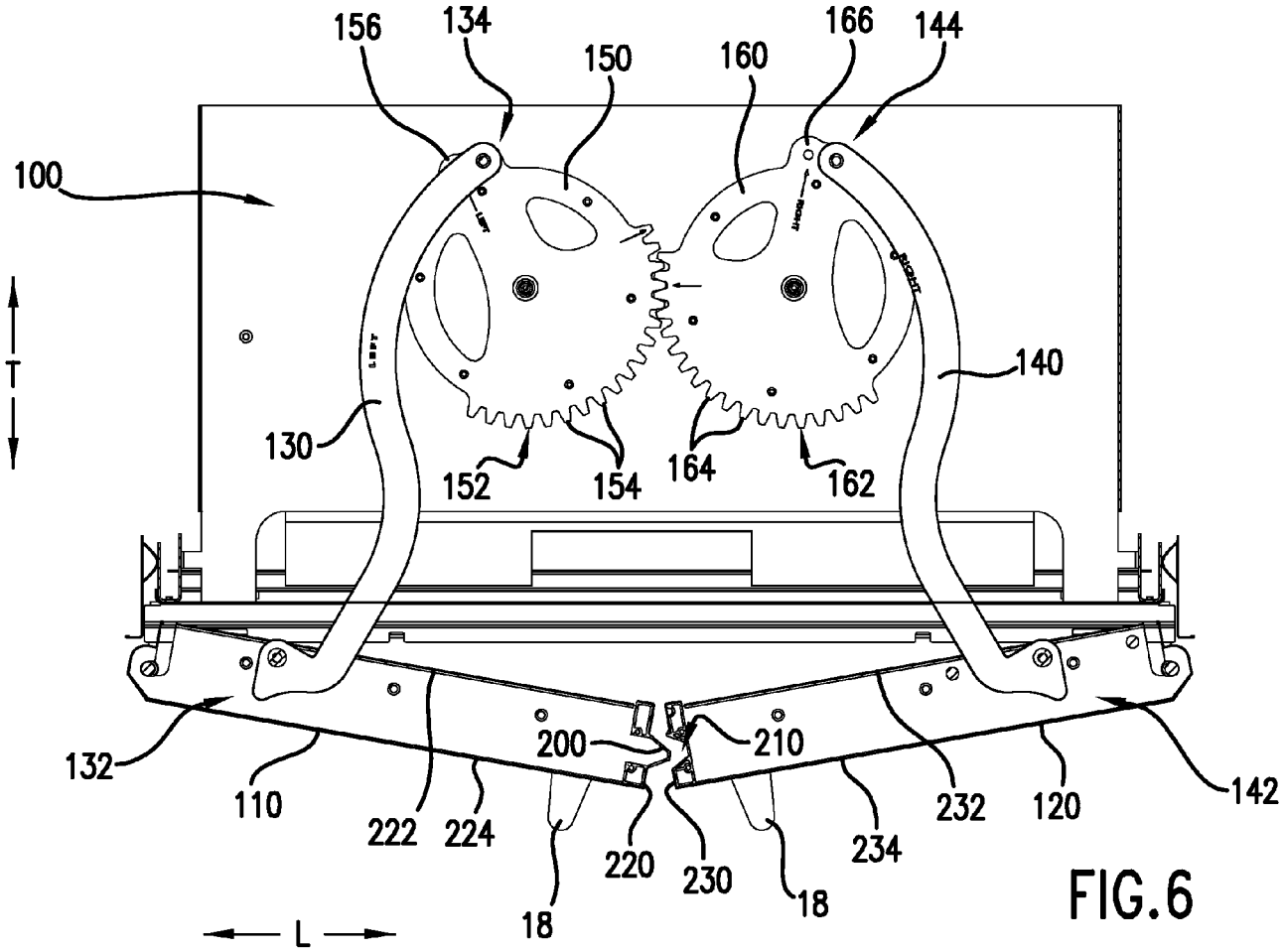
Figure 11:
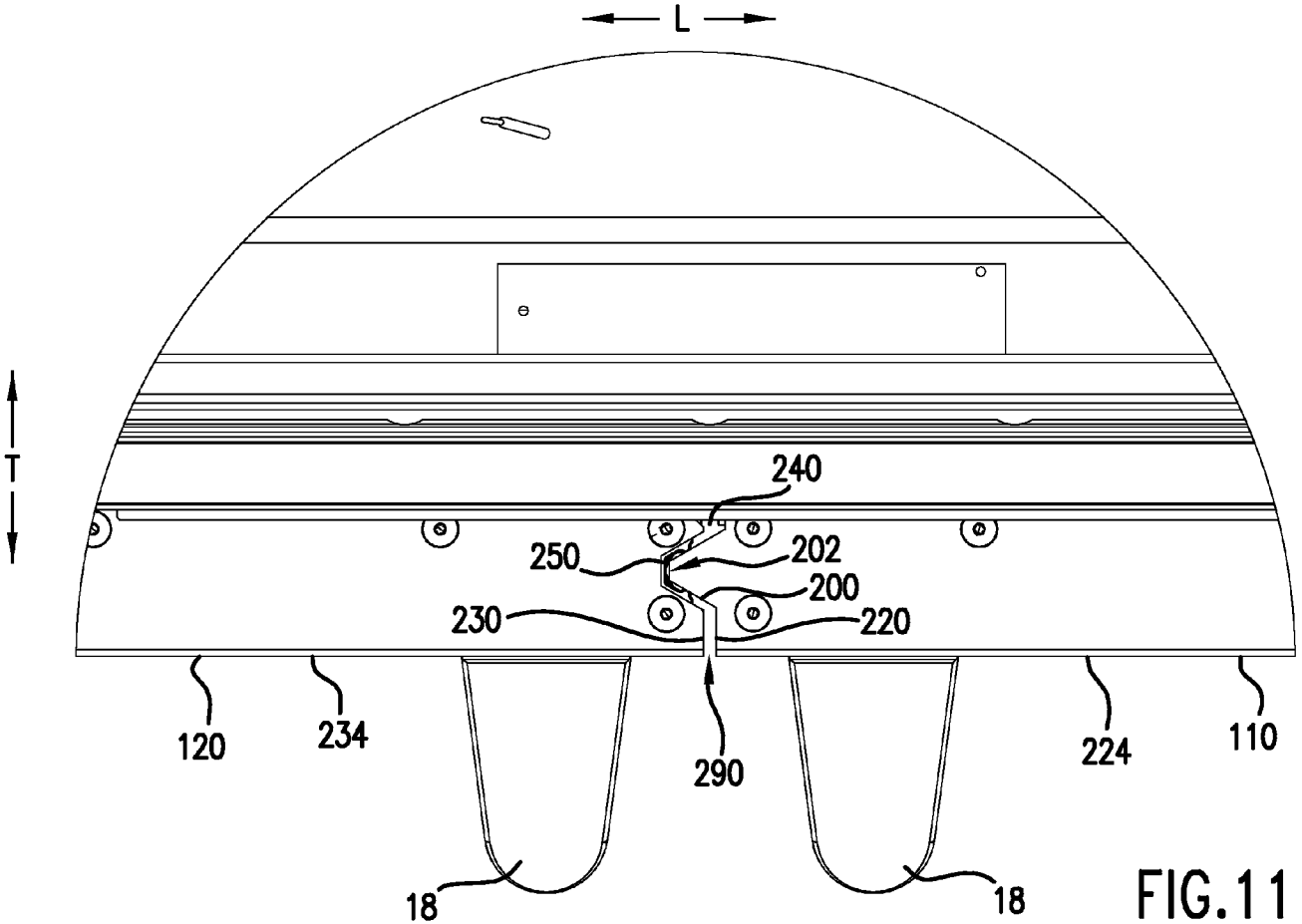

Turning to FIG. 5, first door 110 includes tongue 200. Tongue 200 of first door 110 is positioned on sidewall 220 of first door 110 and extends away from sidewall 220. Tongue 200 is disposed on sidewall 220 such that tongue 200 is spaced apart from both inner surface 222 and outer surface 224 of first door 110, e.g., along the transverse direction T when first and second doors 110 and 120 are in the closed position as shown in FIG. 11.

In addition, second door 120 defines groove 210 configured for receipt of the tongue 200 of first door 110 when first and second doors 110 and 120 are in the closed position. In particular, spanning wall 230 of second door 120 defines groove 210. Groove 210 of spanning wall 230 is spaced apart from both the interior and exterior surfaces 232 and 234 of second door 120, e.g., along the transverse direction T when first and second doors 110 and 120 are in the closed position as shown in FIG. 11.

Figures 12, 13:
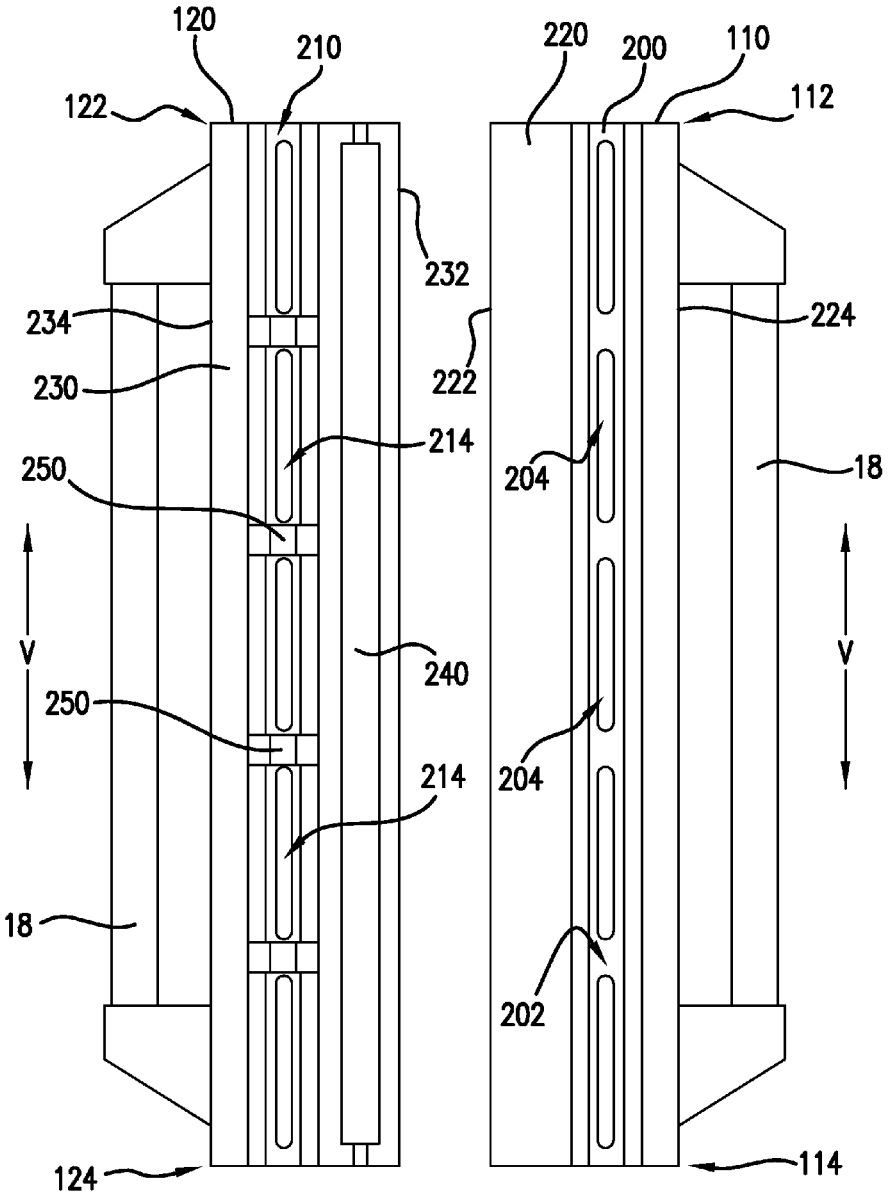
FIG. 12 is a side elevation view of a first door of the oven appliance that particularly illustrates a tongue of the first door positioned on a sidewall of the first door.
FIG. 13 is a side elevation view of a second door of the oven appliance that particularly illustrates a groove defined in a spanning wall of the second door.

FIG. 12 is a side elevation view of first door 110 that illustrates tongue 200 of first door 110 positioned on sidewall 220 of first door 110. FIG. 13 is a side elevation view of second door 120 that illustrates groove 210 defined by spanning wall 230 of second door 120. As may be seen in FIG. 12, first door 110 extends between a top 112 and a bottom 114 along the vertical direction V. Tongue 200 extends longitudinally from top 112 of first door 110 to bottom 114 of first door 110 on sidewall 220. Turning to FIG. 13, second door 120 extends between a top 122 and a bottom 124 along the vertical direction V. Groove 210 extends longitudinally from top 122 of second door 120 to bottom 124 of second door 120 on spanning wall 230.

Figure 9:
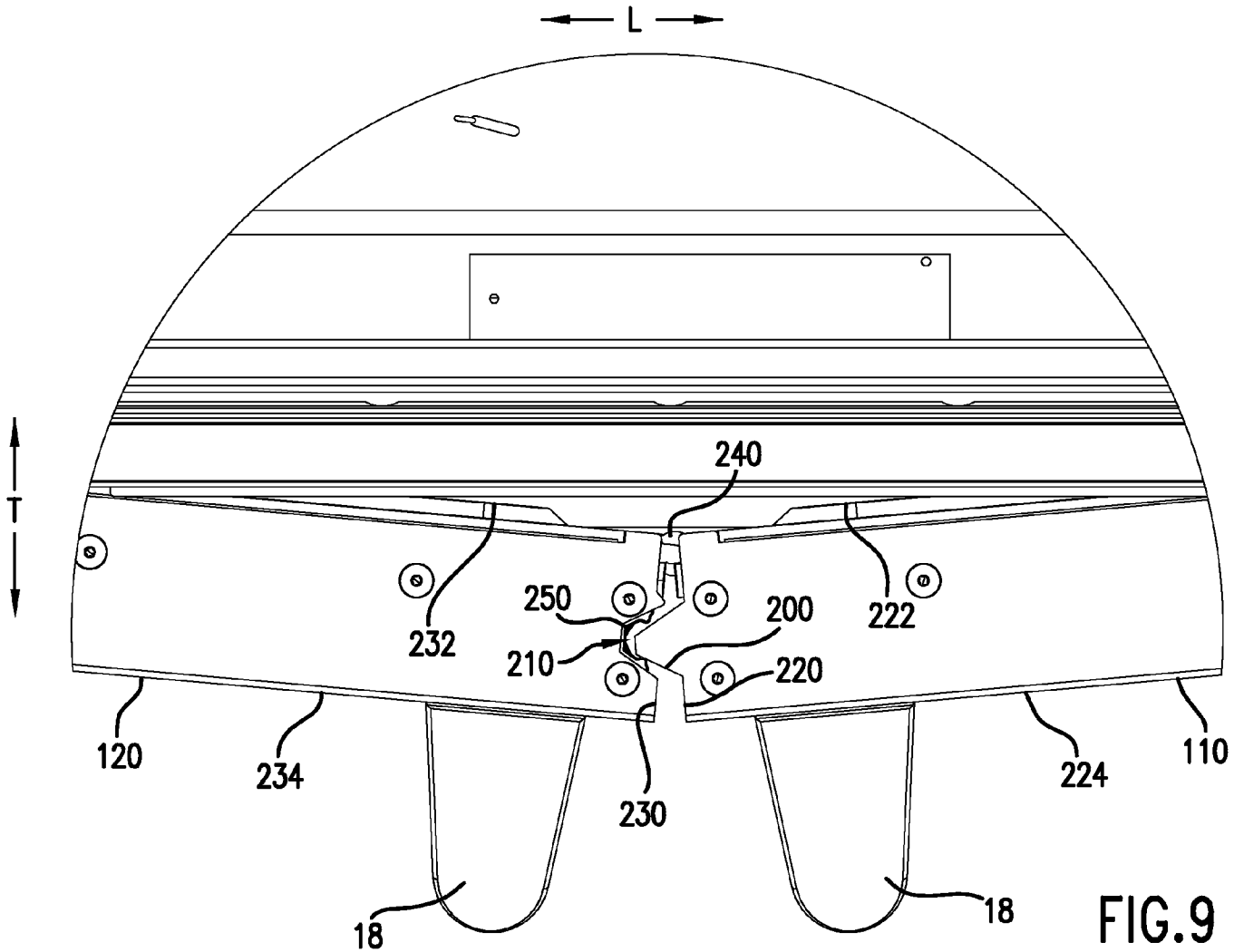
Figure 10:
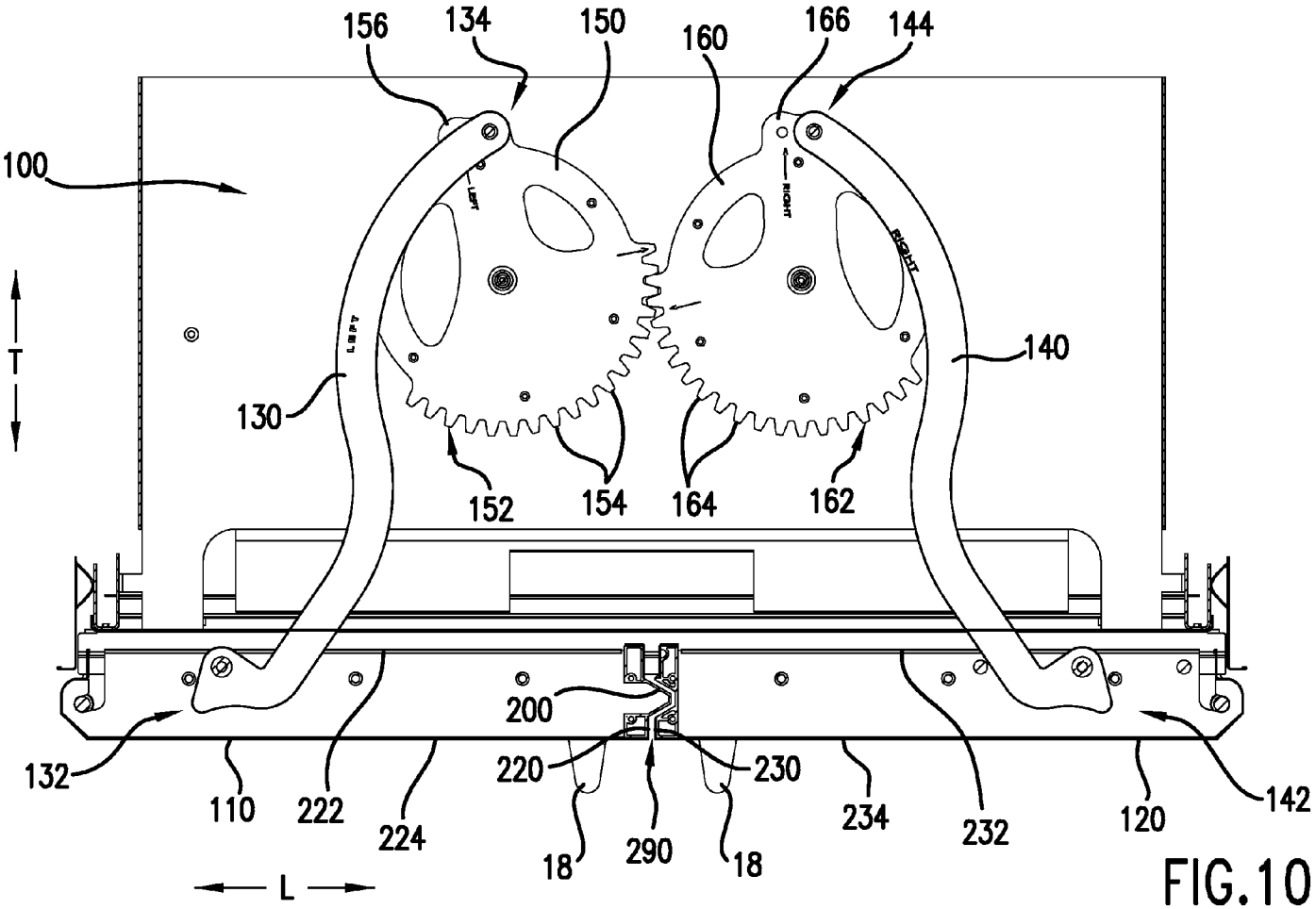

Second door 120 also includes at least one bumper 250 positioned within groove 210 of second door 120. Bumper 250 is configured to contact the tongue 200 of first door 110 when first and second doors 110 and 120 are in the closed position, e.g., as shown in FIG. 11. Bumper 250 can cushion impact of tongue 200 within groove 210 during opening and closing of first and second doors 110 and 120, e.g., as shown in FIG. 9. In alternative exemplary embodiments, bumper 250 may be positioned or mounted on first door 110, e.g., tongue 200 of first door 110.

Second door 120 further includes a gasket 240 mounted to spanning wall 230. Gasket 240 extends longitudinally from about top 122 of second door 120 to bottom 124 of second door 120 on spanning wall 230. Gasket 240 is compressed and extends between spanning wall 230 of second door 120 and sidewall 220 of first door 110 when first and second doors 110 and 120 are in the closed position as described in greater detail below. In alternative exemplary embodiments, gasket 240 may be positioned or mounted on sidewall 220 of first door 110.

As shown in FIGS. 12 and 13, tongue 200 of first door 110 defines a series of apertures 204, and spanning wall 230 of second door 120 defines a series of openings 214 positioned within groove 210 of second door 120. Tongue 200 of first door 110 extends to a distal end or portion 202 that is spaced apart from sidewall 220. The series of apertures 204 is defined on distal portion 202 of tongue 200. The series of apertures 204 is dispersed on tongue 200 along the vertical direction V, e.g., from top 112 of first door 110 to bottom 114 of first door 110. Similarly, the series of openings 214 is dispersed on spanning wall 230 within groove 210 along the vertical direction V, e.g., from top 122 of second door 120 to bottom 124 of second door 120. Each aperture of the series of apertures 204 is aligned with a respective opening of the series of openings 214, e.g., along the lateral direction L, when first and second doors 110 and 120 are in the closed position.

As will be understood by those skilled in the art, oven appliance 10 may include a fan 270 (FIG. 1) or other suitable mechanism for urging a flow of cooling air through the series of apertures 204 of first door 110 and the series of openings 214 of second door 120. As an example, fan 270 can urge the flow of cooling air into a gap 290 (FIG. 11) defined between first door 110 and second door 120 when first and second doors 110 and 120 are in the closed position. From within gap 290 such flow of cooling air can enter series of apertures 204 of first door 110 and the series of openings 214 of second door 120 Such flow of cooling air can assist in preventing first and second doors 110 and 120 from heating to an unsuitable temperature. In addition, such flow of cooling air can assist in hindering hot air from escaping or flowing out of the gap 290.

Turning back to FIG. 5, tongue 200 of first door 110 has a cross-section in a plane that is perpendicular to the vertical direction V. In the exemplary embodiment shown in FIG. 12, the cross-section of tongue 200 is trapezoidal. However, in alternative exemplary embodiments, the cross-section of tongue 200 may have any suitable shape, e.g., triangular, rectangular, or semi-circular. In addition, groove 210 of second door 120 has a profile in the plane that is perpendicular to the vertical direction V. The profile of groove 210 is complementary to the cross-section of tongue 200. Thus, as shown in FIG. 11, tongue 200 of first door 110 is received within and/or engages groove 210 of second door 120 in a commentary manner when first and second doors 110 and 120 are in the closed position.

Figure 7:
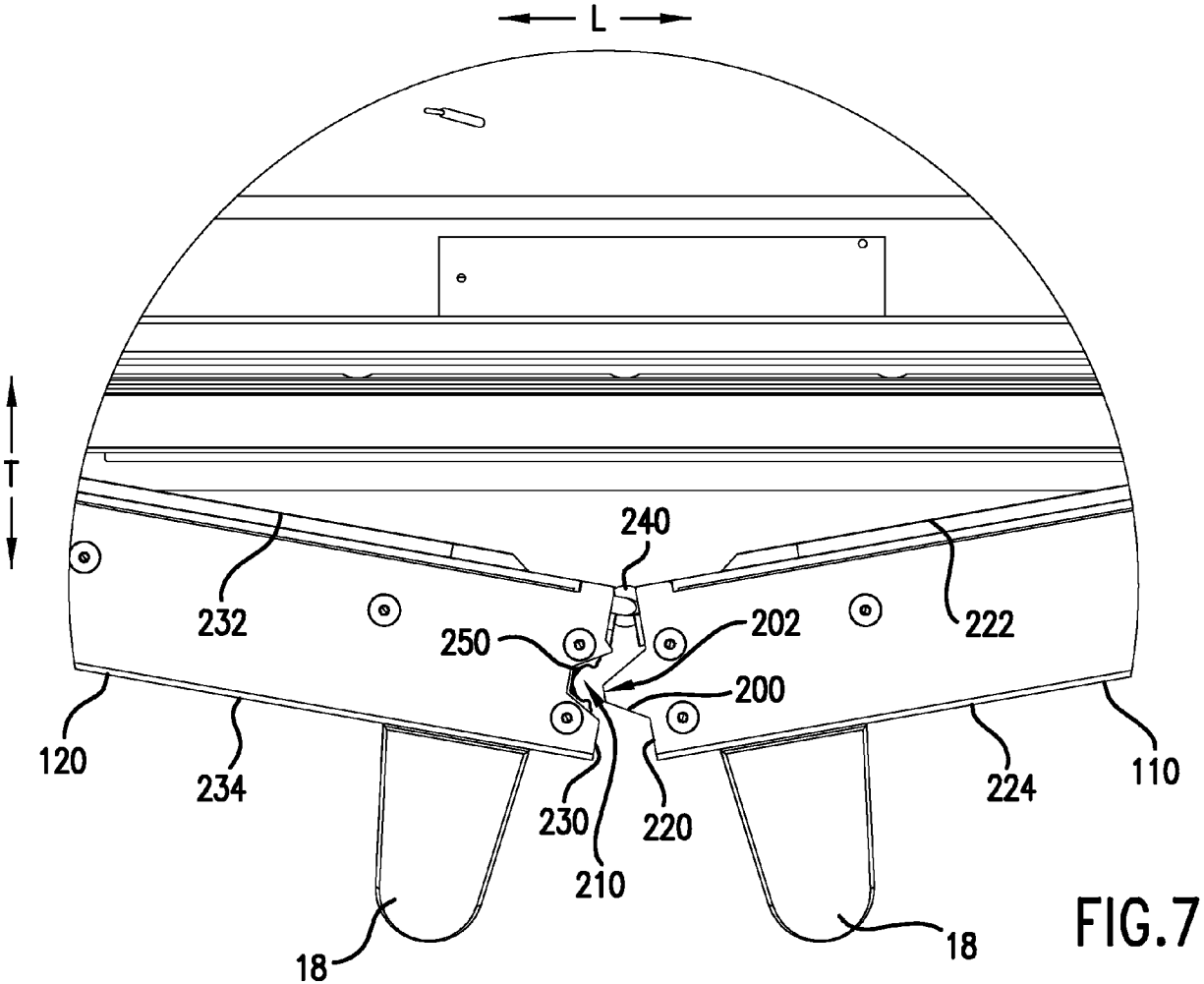
Figure 8:
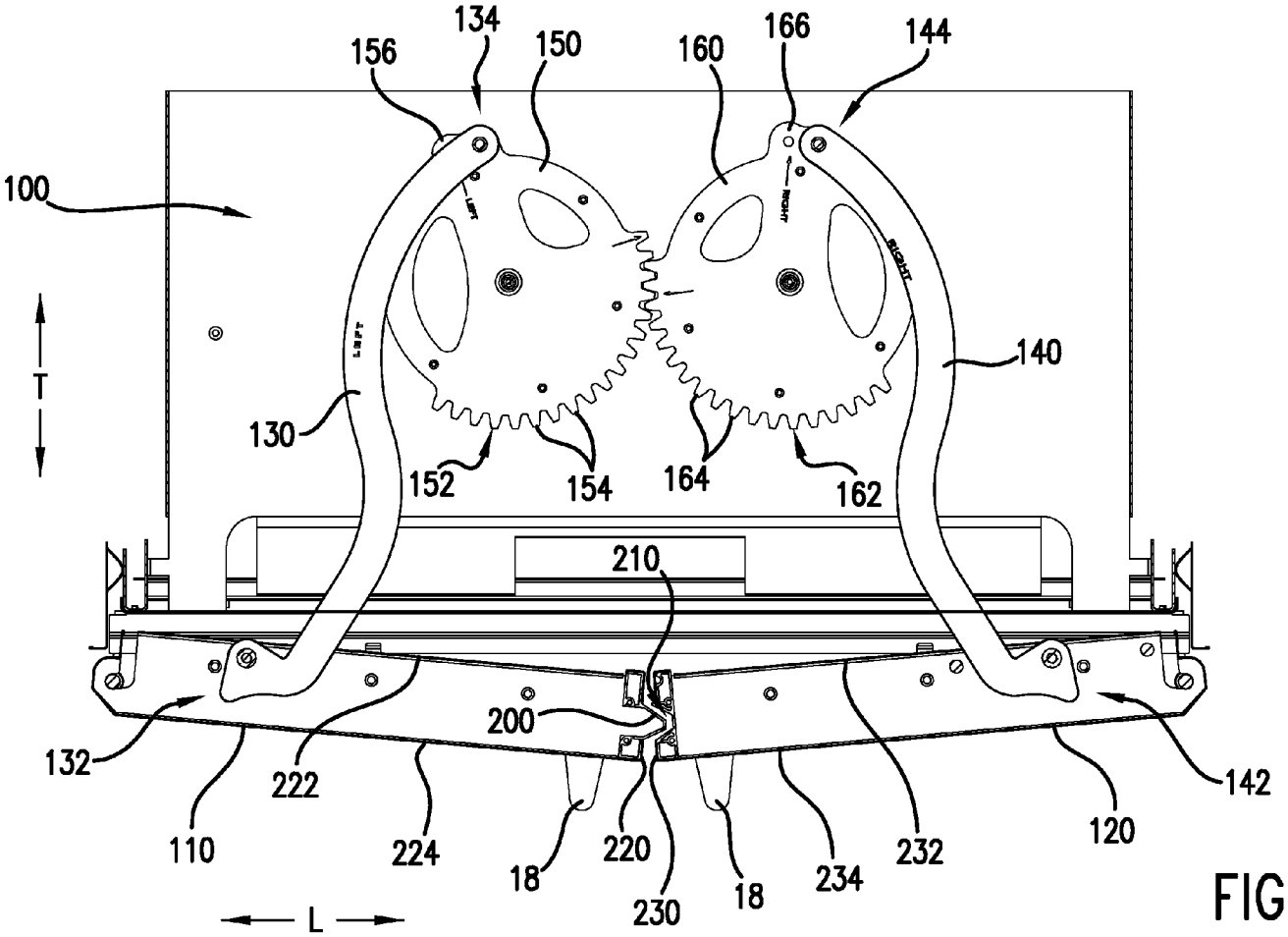

As discussed above linkage assembly 100 connects first and second doors 110 and 120 such that first and second doors 110 and 120 rotate open and closed simultaneously. In addition, tongue 200 of first door 110 is received within groove 210 of second door 120 when first and second doors 110 and 120 are in the closed position. As an example, with first and second doors 110 and 120 in the open position show in FIG. 4, a user may push on handle 18 of first door 110 (or handle 18 of second door 120) to urge first and second doors 110 and 120 to begin rotating closed (i.e., towards the closed position shown in FIG. 10). As first and second doors 110 and 120 begin to rotate closed to the position shown in FIG. 6, sidewall 220 of first door 110 contacts gasket 240 of second door 120 as shown in FIG. 7. As first and second doors 110 and 120 continue to rotate closed to the position shown in FIG. 8, sidewall 220 of first door 110 begins to compress gasket 240 of second door 120 between sidewall 220 and spanning wall 230 of second door 120 as shown in FIG. 9. In addition, tongue 200 of first door 110 is partially positioned within groove 210 of second door 120 and impacts bumper 250 in the position shown in FIG. 8. As may be seen in FIG. 11, when the user rotates first and second doors 110 and 120 to the closed position, tongue 200 of first door 110 is positioned within groove 210 of second door 120. Further, gasket 240 contacts and is compressed between sidewall 220 and spanning wall 230.

As discussed above, tongue 200 of first door 110 is positioned within groove 210 of second door 120 when first and second doors 110 and 120 are in the closed position. Thus, sidewall 220 of first door 110 and spanning wall 230 of second door 120 cooperate to form tongue and groove interface between the first and second doors 110 and 120 when first and second doors 110 and 120 are in the closed position. Such tongue and groove interface can improve oven appliance performance.

For example, tongue 200 and groove 210 can interfere with or impede a flow of heated air through the gap 290 between first door 110 and second door 120. Gasket 240 can also interfere with or impede such flow of heated air through gap 290. Tongue 200 and groove 210 can also permit a user to pull on first door 110 or second door 120 to open both first door 110 and second door 120 when first and second doors 110 and 120 are in the closed position. Tongue 200 and groove 210 can also improve sealing of first and second doors 110 and 120 against seal 20 when first and second doors 110 and 120 are in the closed position by urging first and second doors 110 and 120 to equally compress against seal 20.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, the oven appliance defining a vertical direction, a lateral direction, and a transverse direction, the vertical, lateral, and transverse directions being mutually perpendicular, the oven appliance comprising:

a cabinet defining a chamber for receipt of food items for cooking, said cabinet also defining an opening, the chamber of said cabinet being accessible through the opening of said cabinet;

a heating element for providing heat to food items in the chamber of said cabinet;

a first door mounted proximate the opening of said cabinet, said first door having an inner surface and an outer surface, said first door also having a sidewall that extends between and connects the inner and outer surfaces of said first door, said first door further having a tongue, the tongue of said first door positioned on the sidewall of said first door and extending away from the sidewall of said first door, said tongue spaced apart from both the inner and outer surfaces of said first door, the tongue of said first door defining a series of apertures, the series of apertures dispersed on the tongue along the vertical direction; and a second door mounted proximate the opening of said cabinet, said second door having an interior surface and an exterior surface said second door also having a spanning wall that extends between and connects the interior and exterior surfaces of said second door, the spanning wall of said second door defining a groove configured for receipt of the tongue of said first door when said first and second doors are in a closed position, the groove of the spanning wall spaced apart from both the interior and exterior surfaces of said second door, the spanning wall of said second door defining a series of openings positioned within the groove of said second door, the series of openings dispersed within the groove along the vertical direction.

2. The oven appliance of claim 1, further comprising a fan configured for urging a flow of cooling air through the series of apertures of said first door and the series of openings of said second door.

3. The oven appliance of claim 1, wherein each aperture of the series of apertures is aligned with a respective opening of the series of openings along the lateral direction when said first and second doors are in a closed position.

4. The oven appliance of claim 1, wherein the tongue of said first doors extends to a distal portion, and the series of apertures is defined on the distal portion of the tongue.

5. The oven appliance of claim 1, further comprising:

a first handle mounted to said first door; and a second handle mounted to said second door.

6. The oven appliance of claim 1, wherein said first door and said second door are rotatably mounted to said cabinet.

7. The oven appliance of claim 6, further comprising means for connecting said first door and said second door such that said first door and said second door rotate between an open position and a closed position simultaneously.

8. The oven appliance of claim 1, further comprising a gasket mounted to the sidewall of said first door or the spanning wall of said second door, the gasket extending between the sidewall of said first door and the spanning wall of said second door when said first and second doors are in a closed position.

9. The oven appliance of claim 1, further comprising at least one bumper disposed within the groove of said second door or on the tongue of said first door, said at least one bumper extending between the tongue of said first door and the groove of said second door when said first and second doors are in a closed position.

10. The oven appliance of claim 1, wherein the tongue of said first door has a cross-section in a plane that is perpendicular to the vertical direction, and the groove of said second door has a profile in the plane that is perpendicular to the vertical direction, the profile of the groove being complementary to the cross-section of the tongue.

11. The oven appliance of claim 10, wherein the cross-section of the tongue is trapezoidal.

12. An oven appliance, the oven appliance extending between a top and a bottom along a vertical direction, the oven appliance also extending between a first side and a second side along a lateral direction, the oven appliance further extending between a front and a back along a transverse direction, the vertical, lateral, and transverse directions being mutually perpendicular, the oven appliance comprising:

a cabinet defining a chamber for receipt of food items for cooking, said cabinet also defining an opening, the chamber of said cabinet being accessible through the opening of said cabinet;

a heating element for providing heat to food items in the chamber of said cabinet;

a first door rotatably mounted on the first side of the oven appliance proximate the opening of said cabinet, said first door extend between a top and a bottom along the vertical direction, said first door comprising:

an inner surface;

an outer surface;

a first sidewall that extends between and connects said inner surface and said outer surface; and a tongue positioned on said first sidewall, said tongue having a distal portion that is spaced apart from said first sidewall, said tongue extending longitudinally between the top of said first door and the bottom of said first door along the vertical direction, said tongue defining a series of apertures, the series of apertures dispersed on said tongue along the vertical direction; and a second door rotatably mounted on the second side of the oven appliance proximate the opening of said cabinet, said second door comprising:

an interior surface;

an exterior surface; and a second sidewall that extends between and connects said interior surface and said exterior surface, said second sidewall defining a groove configured for receipt of said tongue when said first and second doors are in the closed position, the second sidewall of said second door defining a series of openings positioned within the groove of said second door, the series of openings dispersed within the groove along the vertical direction.

13. The oven appliance of claim 12, wherein the cross-section of said tongue is trapezoidal.

14. The oven appliance of claim 12, further comprising means for connecting said first door and said second door such that said first door and said second door rotate between an open position and a closed position simultaneously.

15. The oven appliance of claim 12, further comprising:

a first handle mounted to said first door; and a second handle mounted to said second door.

16. The oven appliance of claim 12, further comprising at least one bumper disposed within the groove of said second door or on the tongue of said first door, said at least one bumper extending between the tongue of said first door and the groove of said second door when said first and second doors are in a closed position.

17. The oven appliance of claim 12, further comprising a gasket mounted to the first sidewall of said first door or the second sidewall of said second door, the gasket extending between the first sidewall of said first door and the second sidewall of said second door when said first and second doors are in a closed position.

18. The oven appliance of claim 12, wherein said tongue has a cross-section in a plane that is perpendicular to the vertical direction, and the groove of said second door has a profile in the plane that is perpendicular to the vertical direction, the profile of the groove being complementary to the cross-section of said tongue.

* * * * *